United States Patent [19]

Maier et al.

[11] 4,164,925

[45] Aug. 21, 1979

[54] CENTRIFUGAL RPM GOVERNOR FOR INTERNAL COMBUSTION ENGINES

[75] Inventors: Sieghart Maier, Stuttgart; Werner Lehmann, Gerlingen; Ernst Ritter, Stuttgart; Wolfgang Eckell, Gebersheim; Reinhard Schwartz, Stuttgart, all of Fed. Rep. of Germany

[73] Assignee: Robert Bosch GmbH, Stuttgart, Fed. Rep. of Germany

[21] Appl. No.: 859,510

[22] Filed: Dec. 12, 1977

[30] Foreign Application Priority Data

Dec. 11, 1976 [DE] Fed. Rep. of Germany ..... 2656261

[51] Int. Cl.[2] ..... F02D 1/04

[52] U.S. Cl. ..... 123/140 R; 123/140 MC

[58] Field of Search ..... 123/140 R, 140 MC

[56] References Cited

U.S. PATENT DOCUMENTS

| | | | |
|---|---|---|---|
| 3,577,968 | 5/1971 | Staudt et al. | 123/140 R |
| 3,620,199 | 11/1971 | Kuhn et al. | 123/140 R |
| 3,659,570 | 5/1972 | Yoshino | 123/140 R |
| 3,766,899 | 10/1973 | Isselhorst | 123/140 R |
| 3,946,715 | 3/1976 | Staudt | 123/140 R |
| 4,038,958 | 8/1977 | Susuki | 123/140 R |

FOREIGN PATENT DOCUMENTS

| | | | |
|---|---|---|---|
| 593090 | 5/1959 | Italy | 123/140 R |

*Primary Examiner*—Charles J. Myhre
*Assistant Examiner*—P. S. Lall
*Attorney, Agent, or Firm*—Edwin E. Greigg

[57] ABSTRACT

A centrifugal rpm governor for fuel injected motor vehicles, in which the control stroke, which is detected by a lever controlled follower on an adapting surface, is enlarged for a more precise control of the adaptation. A translated shift lever is used as the control lever, which is coupled with the governor adjusting member and the lever carrying the follower. To improve the quality of the governor, the shift lever engages an adapting lever, which carries the follower and which is arranged nearly parallel to the intermediate lever. By means of an adjusting member, which is provided with an adapting control and retraction spring, and which is separated in the governor and adapting sleeve, the use of the governor as an idling as well as a maximum rpm governor is made possible.

22 Claims, 5 Drawing Figures

CENTRIFUGAL RPM GOVERNOR FOR INTERNAL COMBUSTION ENGINES

BACKGROUND OF THE INVENTION

The invention relates to centrifugal rpm governors for motor vehicles, whose adjusting member can be moved by rpm responsive flyweights against the force of regulating springs, and moves the fuel quantity control member of the fuel injection pump by means of an intermediate lever, which can also be activated by a rotatable setting member to arbitrarily move the fuel quantity control member. The path of the fuel quantity control member is limited on one side in the direction of increased fuel supply by an adjustable stop. This stop determines the full-load fuel supply quantity, can be adjusted in its position in the direction of the long axis of the fuel quantity control member relative to the housing, and is provided with a contoured stop surface. On the other side, the travel of the fuel control member is limited by a follower, which is at least indirectly connected with the intermediate lever. In operation the follower takes a shifted position across the adjusted position of the stop, when the adjusting member changes the position of its pivotal point on a control lever. This control lever, which causes the shifting of the follower, is supported in the housing, and has a force reservoir that is stretched as soon and as long as the intermediate lever is attempting to move the fuel quantity control member past the stop.

There is already known a centrifugal rpm governor of the above type, (DT-PS No. 1,900,675), in which the intermediate lever, which can be moved by the adjusting member as a function of rpm, and which is connected with the fuel quantity control member, carries the follower, and experiences a stroke movement from a single armed control lever located in the governor housing during adjusting movements of the adjusting member. Such a stroke movement is converted into a following movement of the follower on the adapting surface of the stop in the housing when the governor parts are in the full load position. Because the adjusting member must carry out the deregulating stroke for deregulation, and because a part of the adjusting member path has already been used in passing through the idling stage, or in controlling the increased starting quantity, only a correspondingly shorter control path remains for control of the adapting control stroke. Because the control lever is formed as a single armed lever, a small adjusting stroke serves to control the adaptation, and this leads to a correspondingly short following path of the follower on the adapting surface of the stop in the housing that determines the adaptation. Governors with the described adapting surface are, however, for the most part usually only employed when a so-called negative adaptation and perhaps additionally a positive adaptation is to be controlled. The negative adaptation effects a full-load quantity decrease in lower rpm ranges when the rpm is falling, that is it operates against the tendency of the governor. By means of the small following path available on the adaptation curve, it is difficult to achieve a sufficiently accurate control of the adaptation.

In the known centrifugal rpm governor, commonly referred to as a so-called variable-speed governor, a varying maximum rpm is regulated depending on the position of the adjusting member. For vehicle engines, however, it usually is desirable that the governor operates as a so-called idling and maximum rpm governor. But in such governors it is very difficult to achieve an adapting control between the idling and maximum rpm, because during rpm increases beyond the idling rpm, the adjusting member normally does not carry out any motion. It regulates the idling rpm and does not again become active until the limiting maximum rpm is attained.

OBJECT AND SUMMARY OF THE INVENTION

Accordingly, the principal object of the invention is to provide a centrifugal rpm governor which achieves an enlarged follower path on the adaptation curve while changing the structural elements of the governor only slightly, the follower path being enlarged as compared to the adapting control stroke controlled by the adjusting member.

Another object of this invention is to provide a governor, the regulating quality of which is substantially improved by an additional adapting lever that carries the follower and is arranged at least nearly parallel to the intermediate lever. With such a structure the intermediate lever experiences no additional stroke motion during its regulating movements.

An important advantage of this invention results from the centrifugal rpm governor being able to operate as an idling and maximum rpm governor.

A still further advantage provided by this invention is that by means of the adjustment of the retraction spring, a positive adaptation in an otherwise not regulatable partial load range is possible.

Yet another object of this invention is to be able to provide an adaptation in partial-load that is proportional to the adaptation of the full-load range.

The invention will be better understood and further objects and advantages thereof will become more apparent from the ensuing detailed description taken in conjunction with the drawings where four exemplary embodiments of the invention are shown schematically.

DESCRIPTION OF THE PREFERRED EMBODIMENTS

Figure 1:
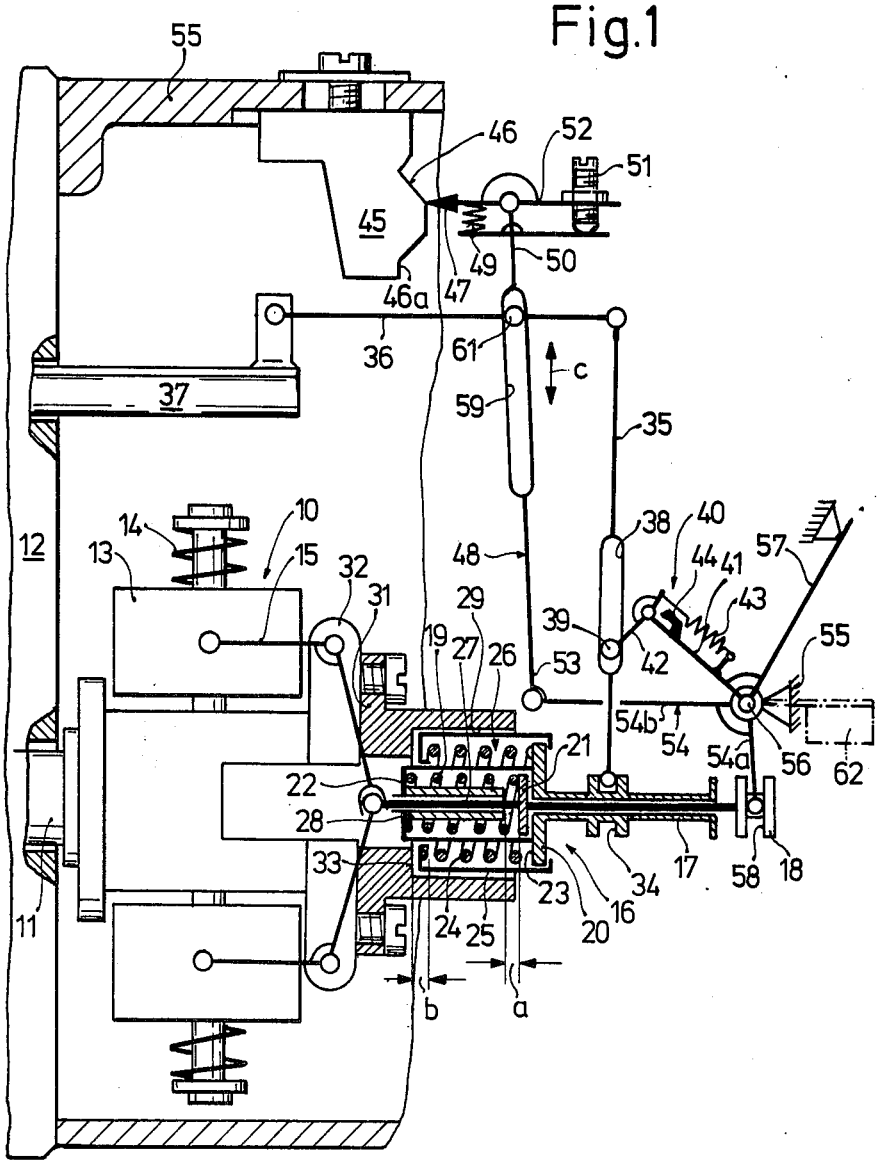
FIG. 1 is the first embodiment of an idling and maximum rpm governor.

The first embodiment of the centrifugal rpm governor illustrated in FIG. 1 is constructed as a so-called idling and maximum rpm governor, whose flyweight regulator 10 is attached to the drive shaft 11 of a known and only partially shown fuel injection pump 12. The flyweight regulator 10 includes the usual flyweights 13, which move away from the axis of the drive shaft 11 in a known manner under the influence of centrifugal force against the force of regulating springs 14. These regulating movements are transferred to an adjusting member 16 by means of lever 15.

The adjusting member 16 includes a regulating sleeve 17 and a telescoped adapting sleeve 18 as the major elements which are both fastened to a sub-assembly on the same axis and extend coaxially to each other. The adapting sleeve 18 is directly connected with the flyweights by means of the lever 15 while the regulating sleeve 17 is coupled in an elastic yielding manner with the adapting sleeve 18 by means of an adapting control spring 19. By means of the tensional force of the adapting control spring 19, both sleeves 17 and 18 are held in the position shown in the drawing until the tensional force of the adapting control spring 19 is overcome by corresponding regulating forces that are described hereinafter. One end of the adapting control spring 19 is supported on a shoulder 21 of the adapting sleeve 18, while the other end is supported in an enclosure element 22 that is associated with the regulating sleeve 17. The regulating sleeve 17 includes a flange 20 that projects past the enclosure element 22 and forms a shoulder 23, which serves as a support for a retraction spring 24 with the opposite end of the spring 24 being supported by an inner shoulder of a capsule 25. The capsule 25 includes further shoulder means that engages the outer wall of flange 20 of the regulating sleeve 17 and is held in the position shown by the tensional force of the retraction spring 24. This spring 24 thereby serves as the stroke limiting element for a sub-assembly of the adjusting member 16, which is designated as the control capsule 26. This control capsule 26 includes the retraction spring 24, the enclosure element 22 of the regulating sleeve 17, the adapting control spring 19 and an extension 27 of the adapting sleeve 18 that is provided with the shoulder 21, all of which extend coaxially relative to each other. An additional sleeve element forms a stop 28 that is inserted between the extension member 27 and the adapting control spring 19, the length of the sleeve 28 being arranged to determine the adapting control stroke "a".

The capsule 25, which serves as the stroke limiting part for the adjusting member 16 is guided in a slot 29 of a guide element 31, which is fixedly connected with a flyweight carrier 31, and thus forms a part of said carrier. In the position shown in the drawing, the capsule 25 lies against a shoulder 33 of the slot 29 after the idling stroke "b" of the adjusting member 16 has been completed.

The regulating sleeve 17 includes an annular groove 34 that is coupled with one end of an intermediate lever 35 by means of a simplified connection such as that shown, with said intermediate lever being formed as a slotted lever, the other end of which is connected with the fuel quantity control member 37 by means of a side bar 36 and thus serves as the supply adjusting member of the fuel injection pump 12. The lever 35 includes a guide slot 38 in which is slidably disposed a pin 39 that is associated with a linking element 42, which is connected with a steering lever 41. The linking element 42 is tensed in the position shown by a spring 43, which urges the linking element 42 clockwise against a path limiting stop 44. Thus, this elastic yielding sub-assembly that is provided on the steering lever 41 serves as a force reservoir generally denoted as 40, which is tensed as soon and as long as the intermediate lever 35 is attempting to move the fuel quantity control member 37 past the position where it is held by a stop element 45. This condition occurs over the entire range of the adapting control, except when the position controlling the greatest possible injection quantity is achieved, and during starting and deregulation.

The stop element 45 is adjustable and includes convergent surfaces, one of which is a contoured stop surface 46, and the other of which is a starting step **46*a*, on which is supported a follower 47 that serves as a counter stop, which is located for example, at the end of an adapting lever 48. The simplified follower 47, that is denoted in the drawing as an arrow, can either be formed as an element having a sharp polished front surface, or be a small ball (see FIG. 2) or even a small ring-type bearing (see FIG. 3), in order to decrease the frictional resistance as the follower moves with the adapting lever 48. The follower 47 is attached to a rocker arm 52, which can be adjusted by a screw 51 against the force of a spring 49, and this enables an adjustment of the follower 47 as opposed to the stop curve 46 in a given position of the adapting lever 48. The adapting lever 48 that is provided at its upper end 50 with the follower 47, is pivotally connected at its other end 53 with a shift lever 54 that is formed as an angle lever which is supported on a pivot means 56 that is mounted in the governor housing 55** (only partially shown).

The steering lever 41 and an adjusting lever 57 which serves as the setting member are attached on the lever shaft 56 in a set angular position relative to each other.

The shift lever 54 serves first to transfer the adapting control stroke "a", which was previously transferred from the flyweights 13 to the adapting sleeve 18, to the adapting lever 48 carrying the follower 47. The adapting lever 48 moves, of course, also during the idling stroke "b" and during the deregulating stroke. In this device the shorter lever arm **54*a* of the shift lever 54 engages in an annular groove 58 of the adapting sleeve 18 that serves as a carrier means, and the other longer lever arm 54*b* is pivotally connected with the end 53 of the adapting lever 48, so that control movements of the adapting sleeve 18 along with the corresponding transfer in stroke movements of the adapting lever 48 are converted, and the follower 47 is accordingly guided along the contoured stop 46 of the adjustable stop 45. During the movement of the follower 47 relative to the contoured stop 46, it also carries out in addition to the described stroke movement in the direction of the arrow c, a further movement in the direction of the long axis of the fuel quantity control member 37, all of which is made possible by the pre-tensed position of the force reservoir 40 as shown in FIG. 1. Similar to the intermediate lever 35, the adapting lever 48 also has a connecting guide slot 59, which is arranged in proximity to the point of attachment of the follower 47 on the adapting lever 48 and in which a carrier pin 61, which is fixedly connected with the side bar 36, engages, thereby maintaining an established preset distance from the intermediate lever 35. Movements of the adapting lever 48 effected by the follower 47 are transferred directly to the intermediate lever 35 through the guide slot 59 and pin 61, thence to the side bar 36 and finally to the fuel quantity control member 37, which carries out corresponding control movements in the injection pump 12**.

In order to compensate at least for most of the weight of the compensating lever 48, which is provided with the follower 47 and the associated elements, which weight loads the shift lever 54, a compensating weight 62 can also be used, as shown by the broken line on the shift lever 54 as an additional lever arm. In place of this weight 62, a suitable compensation might also be provided such as by providing a spring means, as will now be described in the following description of FIG. 2.

Figure 2:
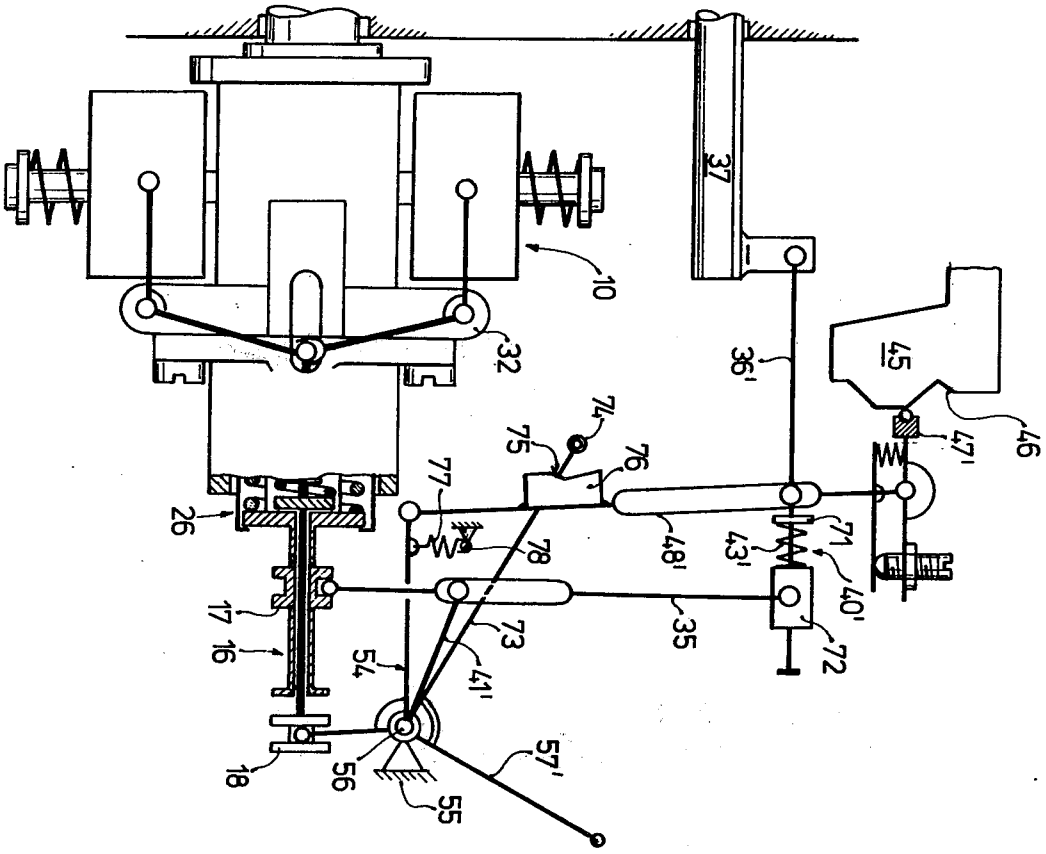
FIG. 2 is the second embodiment of the invention which includes a partial-load adapting curve.

Turning now to FIG. 2, the corresponding elements of this embodiment are provided with the same reference numerals as used earlier, while the new elements are given a different identity. This second embodiment is slightly different from that disclosed in FIG. 1, as can be seen from examining this view. Thus, the flyweight regulator 10, the adjusting member 16 comprising the regulating sleeve 17 and the adapting sleeve 18, with the control capsule 26 guided in the flyweight carrier 32 of the flyweight regulator 10, as well as the intermediate lever 35 and the fuel quantity control member 37 coupled thereto are identical with those of the first embodiment in FIG. 1. As distinguished from the structure of FIG. 1, a steering lever 41', which is rigidly connected with the setting member 57' and is formed as a rigid lever, and the function of the force reservoir 40 in FIG. 1 is assumed by an elastic yielding member 40' that is provided on the side bar 36' between the intermediate lever 35 and the fuel quantity control member 37. The force reservoir 40' basically includes a spring 43', one end of which is supported on a shoulder 71 affixed to the side bar 36' and the other end of which abuts a retraction member 72 that is coupled with an extremity of the intermediate lever 35.

According to the position shown in FIG. 2 of the ball follower 47' on the contoured stop surface 46 of the stop element 45, the force reservoir 40' is placed under tension. Adjacent to the steering lever 41', an additional lever arm 73 is rigidly connected with the setting member 57' which is fixedly attached on the lever shaft 56. This additional lever arm 73 carries a follower roller means 74 at its extreme end, which follower contacts a partial-load adapting curve 75 when the adjusting lever 57' is moved out of the full-load position and clockwise into a corresponding partial-load position. This partial-load adapting curve 75 is machined into the outer surface of an adapting curved element 76, which is firmly connected with the adapting lever 48'. Advantageously, the length of the partial-load adaptation curve can be so chosen, that when the setting member 57' is moved back into the idling position, and the adjusting member 16 and its adapting sleeve 18 are in their corresponding positions, (the sleeve 18 by means of the shift lever 54) the adapting curved element 76 that is connected with the adapting lever 48' arrives in a position in which the follower roller means 74 can be led past the end of the partial-load adapting curve 75, so that partial-load adaptation is not effective during idling.

Also, as distinguished from the embodiment shown in FIG. 1, is the weight equalization of the adapting lever 48', that is it is not accomplished by means of a counterweight, but rather by means of a tension spring 77, which engages one of the lever arms of the shift lever 54, and is supported on a bolt 78 in the governor housing 55.

As an analogous solution, the adapting curved element 76 can of course also be connected with the lever arm 73, and the follower roller means 74 would then be supported on the adapting lever 48' (not shown).

Figure 3:
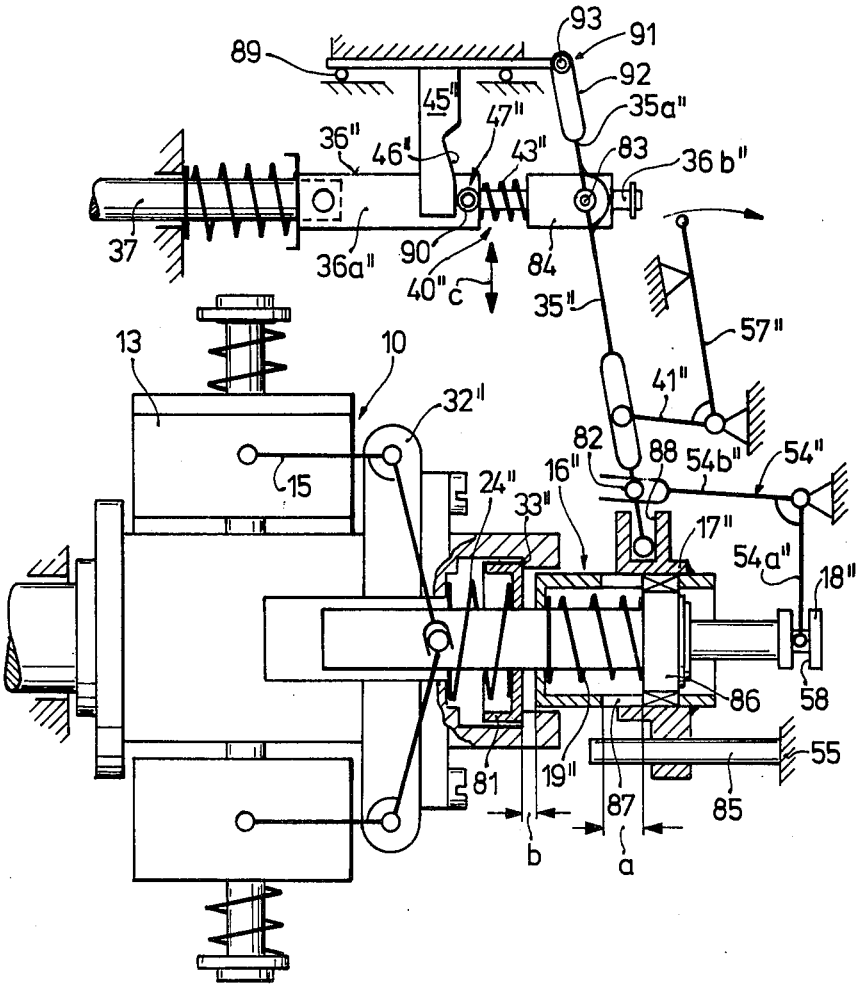
FIG. 3 is the third embodiment of the invention showing a centrifugal rpm governor operating as an idling and maximum rpm governor with an additional partial-load adaptation controlled by the full-load adaptation curve.

Turning now to FIG. 3, the third embodiment has the flyweight regulator 10 coupled with an adjusting member 16", whose adapting control spring 19" and retraction spring 24" are not arranged like the springs 19 and 24 shown in FIGS. 1 and 2 and coaxially to each other, but rather on the same axis behind one another. A spring cup member 81, which is loaded by the retraction spring 24" and is pressed against a shoulder 33" in the flyweight carrier 32", serves as the stroke limiting part for the regulating sleeve 17". This regulating sleeve 17" lies against the spring cup member 81 after completion of the idling stroke "b" and remains in this position until the deregulating rpm is reached and the force of the retraction spring 24" is overcome. The flyweights 13 are connected with the adapting sleeve 18", which is guided inside the regulating sleeve 17", by means of the angle lever 15. The adapting sleeve 18", like the adapting sleeve 18, has an annular groove 58 which serves as a carrier, and in which a lever arm 54*a*" of the shift lever 54" engages, with the other lever arm 54*b*" being coupled with an intermediate lever 35" by a firm carrier pin means 82.

The intermediate lever 35" is coupled with a side bar 36" by means of a linking bolt 83, and the side bar 36" is connected as noted earlier herein with the fuel quantity control member 37. The side bar 36" carries the follower 47", which is provided with a ball bearing member 90, on a part 36*a*" that is connected with the fuel quantity control member 37, and the follower 47" is thus directly connected with the intermediate lever 35". The linking bolt 83 is firmly attached to a slide member 84, which is slidably guided on an elongated shank end 36*b*" of the side bar 36", and can be pushed relative to the part 36*a*" of the side bar 36" against the force of a spring 43", thus serving together with the spring 43" as a force reservoir 40".

The regulating sleeve 17" is secured against rotation and is guided on an elongated rod 85 that is mounted in the governor housing 55. Further, the sleeve 17" is connected with the adapting sleeve 18" by means of a slide ring 86, so that the adapting sleeve 18" can perform the adapting control stroke "a" against the force of the adapting control spring 19", which is made possible by a corresponding slide guide 87 in the regulating sleeve 17". Thus, during control movements of the adapting sleeve 18", a corresponding stroke movement is transferred to the intermediate lever 35" through the shift lever 54", which leads to a corresponding stroke movement of the follower 47" along an adapting surface 46" of the stop 45". This stroke movement of the intermediate lever 35", illustrated by the arrow c, is made possible by a connecting link annular guide member 88 in the regulating sleeve 17".

In contrast to the embodiments according to FIGS. 1 and 2, the stop element 45", which is provided with the adapting stop surface 46", is not firmly located in the governor housing 55 and only adjustable in the axial direction of the fuel quantity control member 37, but here a shifting of the position of the adapting curve 46" can be controlled by a slide guide 89 in dependence on the movements of the intermediate lever 35", which is made possible by an associated coupling means 91. This coupling means 91 comprises a guide element 92 which is similar to a connecting link guide and forms an extension of the lever arm 35*a*". This guide element 92 allows the stroke movements of the intermediate lever 35" controlled by the shift lever 54", and is linkedly connected with the stop 45" by a pivot means 93. This coupling means 91 between the intermediate lever 35" and the stop 45" leads to an adaptation of the fuel supply effective even in the partial-load range, according to the curve of the adapting surface 46" on the stop element 45".

During the idling stroke "b" described above, the adapting sleeve 18'' and the regulating sleeve 17'' operate as a rigid unit, because of the tensional force of the adapting control spring 19''. After the regulating sleeve 17'' moves into contact with the spring cup member 81 which serves as the stroke limiting part, then the adapting control spring 19'' retracts as the rpm continues to climb and the flyweights continue their regulating movements. The adapting sleeve 18'' transfers these control movements to the intermediate lever 35'' and thereby to the follower 47'' by means of the shift lever 54'' when the regulating sleeve 17'' is inoperative. The adapting control movements are described in more detail further hereinafter.

The tensional force of the retraction spring 24 as well as 24'' is chosen in the embodiments according to FIGS. 1 through 3, so that either will block the regulating sleeve 17, 17'' during the adapting control movements (adapting control stroke "a"), but does not hinder the deregulation controlled by the flyweights 13 against the force of maximum rpm regulating springs. In other words, the tension of the retraction springs 24 and 24'' is lower than the forces transferred to the adjusting member 16, 16'' by the angle lever 15 during deregulation by the flyweights 13.

By appropriate selection of the tension of the retraction springs 24 and 24'', however, it is possible that these springs might serve as control springs for a positive adaptation, and a shifting of the regulating sleeve 17, 17'' before the maximum rpm is reached makes it possible that a so-called positive adaptation can also be controlled when the setting member 57, 57'' is in the so-called partial-load range.

In the simplified exemplary embodiments of the flyweight regulator 10 shown in FIGS. 1 through 3, what is concerned is a flyweight regulator of an idling and maximum rpm governor of the type RQ produced by Robert Bosch GmbH, Stuttgart (see for example Publication VDT-UBP 211/3), in which the spring sets contained in the flyweights 13 are produced with or without elements for an adapting device, in a known manner. If the flyweight regulator 10 contains elements that control an adapting phase, then the adapting control spring 19 or 19'' in the adjusting member 16 or 16'' serves only to transfer force differences and as a retraction spring. When there is no adapting phase, these springs must completely take over the adapting control function.

Figure 4:
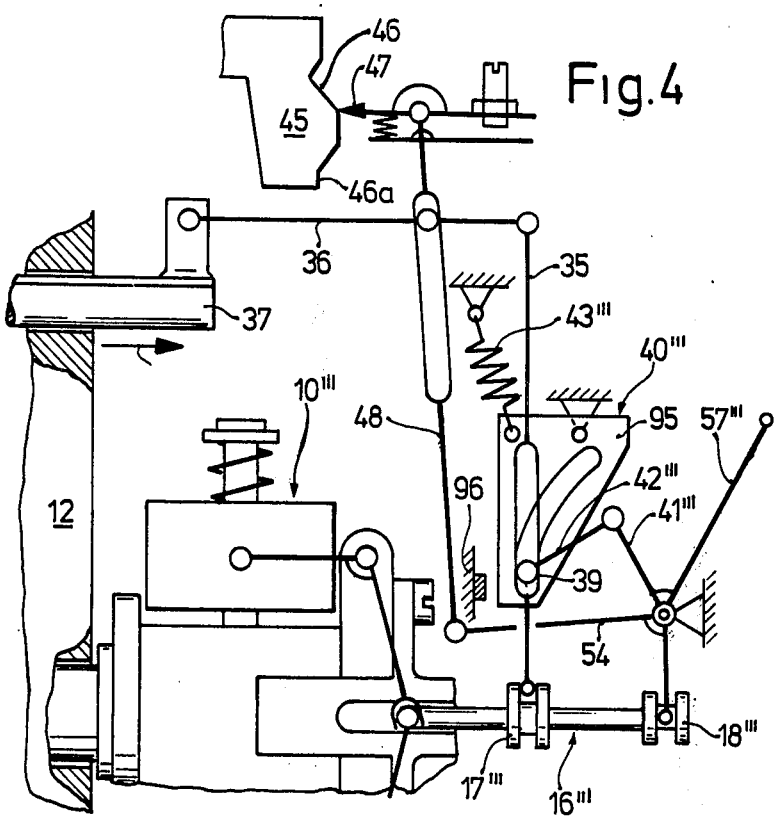
FIG. 4 is the fourth embodiment of a centrifugal rpm governor according to the invention which is arranged as a variable-speed governor.

Turning now to the fourth embodiment of this invention illustrated in FIG. 4, there is shown a so-called variable speed governor, in which random rpm between the idling and maximum rpm can be regulated by the position of the adjusting lever 57''', which serves as the setting member, with the appropriate tension of a curve plate 95 which is a part of a force reservoir 40'''. The force reservoir 40''' serves in the present example, however, also as a retraction member and allows the movement of the fuel quantity control member 37, which is controlled by the follower 47 on the contoured stop surface 46 of the stop element 45. The adaptation, which is controlled by the stop element 45 and the follower 47 as well as the associated adapting lever 45, is described in more detail in the present example, because it corresponds to the example described in FIGS. 1 and 2. The flyweights 10''' contain, as a rule, only one set of idling and adjusting rpm-regulating springs, in a known manner. The adjusting member 16''' contains two rigidly connected sleeve parts, namely the regulating sleeve 17''' and the adapting sleeve 18'''.

The curve plate 95 of the force reservoir 40''' is shown in its position against the force of a spring 43''', which it assumes before the beginning of the adaptation. The setting member 57''' is shown in its angle position which is provided for the control of a maximum rpm. After the adaptation controlled by the contoured stop surface 46 has been completed, and the maximum rpm has been simultaneously attained, the stop plate 95 lies against a stop 96 in the housing, and as the rpm climbs further, the intermediate lever 35 is rotated by the regulating sleeve 17''' around the pin 39 of a link part 42''' of a steering lever 41''', which pin serves as the instantaneous point of rotation. The steering lever 41''' is rigidly connected with the setting member 57'''. With this deregulating movement the fuel quantity control member 37 is moved by the side bar 36 in the direction of the arrow "stop" to decrease the fuel injection quantity supplied from the injection pump 12.

Figure 5:
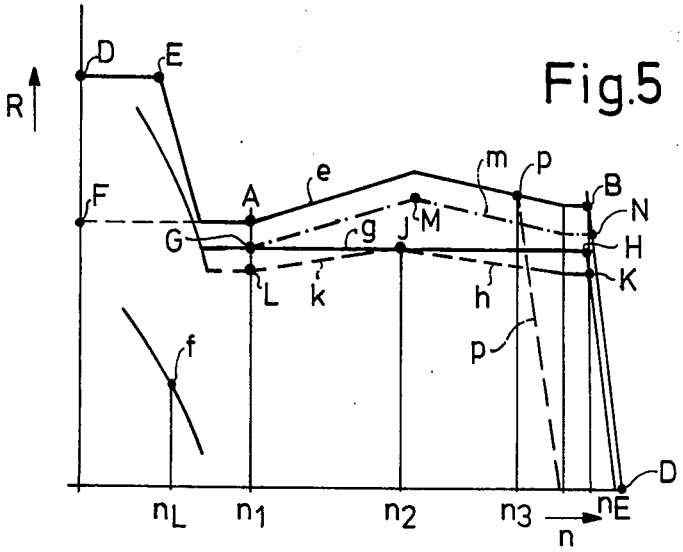
FIG. 5 is a diagram of the adapting and regulating curves made possible by the invention.

The diagram according to FIG. 5 serves to show graphically the function of the exemplary embodiments displayed in FIGS. 1 through 4.

Engine or pump drive shaft rpm "n" is shown along the abscissa, and the position R of the fuel quantity control member 37 is shown along the ordinate. The curve "e" shows the course of the regulating path R over the rpm "n" for an idling and maximum rpm governor according to FIGS. 1 through 3, as well as also for the adjusting governor according to FIG. 4.

With the aid of FIGS. 1 and 5, the function of the first exemplary embodiment will now be explained.

In the position of the adjusting member 16, shown after completion of the idling phase "b", at the rpm $n_1$ the follower 47 stands at the beginning of the adapting surface 46 of the stop element 45, corresponding to the point A of the regulating curve "e" in FIG. 5. As the rpm then climbs beyond the rpm $n_1$, the curve "e" is traversed up to the deregulating point B. During this operation the regulating sleeve 17 remains in the position shown because of the tensional force of the retraction spring 24, but the adapting sleeve 18 leads the adapting control stroke "a" against the force of the adapting control spring 19. The shift lever 54 is rotated clockwise, lifting the adapting lever 48. The follower 47 is led along the contoured stop surface 46. At point B in FIG. 5, the follower 47 has completed the control movement determined by the contoured stop surface 46. When the linked part 42 of the force reservoir 40 is relieved of tension and lies against its path limiting stop 44, the intermediate lever 35 rotates around the pin 39 as the maximum rpm $n_E$ is passed while the spring 24 is simultaneously retracted. By means of this clockwise rotational movement of the intermediate lever 35, the fuel quantity control member is pulled in the "stop" direction by means of the side bar 36. At point "C" in FIG. 5, the fuel quantity control member 37 has arrived in its stop position.

An idling regulating curve "f" serves to maintain the idling rpm $n_L$, and the associated function is known and will not be described in greater detail.

Between the point D and E of the curve "e", an increased starting fuel quantity, which is needed to start the internal combustion engine, is fed into the internal combustion engine. This increased starting quantity is determined by the starting step **46*a* on the stop element 45, and by the follower 47 cooperating with this starting step 46*a*, when the adjusting member 16 is in its rest position (not shown), that is, before completion of the idling phase "b" and when the setting member 57 is in the full-load position, as shown. An increased starting quantity can also be controlled in a known manner by the follower 47 traveling over the stop element 45 in the start position of the governor elements, then as the governor is accelerated, it is made possible by the elastically yielding counterpoise 52, for the follower 47 to snap back behind the stop 45 and return to its contact with the contoured stop surface 46. If no increased amount of fuel is desired for starting the internal combustion engine, then the control of the full-load quantity of fuel supply is provided at starting between the points F and A, and the starting step 46a is bypassed on the contoured stop surface 46**.

When the setting member 57 is taken out of the full-load position shown in FIG. 1, a partial-load curve "g" is controlled, which runs in a straight line between the rpm $n_1$ and $n_E$ between the points G and H, that is, no partial-load adaptation takes place.

If a positive adaptation is desired in the partial-load range, then, as described above, a positive adaptation between the rpm $n_1$ and $n_E$ can be controlled, for example by an appropriate choice of the retraction spring 24. This adaptation is drawn in as curve "h", running between the points J and K.

The function of the second exemplary embodiment, shown in FIG. 2, is substantially the same as that described for FIG. 1, but with the centrifugal rpm governor according to FIG. 2, a random partial-load adaptation can be controlled, such as is shown by the combined dotted curve k-h, drawn between the rpm $n_1$ and $n_E$ between the points L-J-K in FIG. 5. This partial-load adaptation is controlled by the partial-load adaptation curve 75, which was previously described with reference to FIG. 2. This partial-load adaptation curve 75 is controlled by the motions of the follower roller 74, when the setting member 57 is rotated clockwise and the lever arm 73 is moved accordingly under a partial-load.

By means of the third exemplary embodiment shown in FIG. 3, a partial-load adaptation can also be controlled, which, however, extends parallel to the part of the curve "e" between the points A and B, because of the shifted position of the contoured stop surface 46'' on the stop 45''. This type of curve is drawn in FIG. 5 as the broken line curve "m", with its connecting points G-M-N.

By means of the adjusting rpm governor shown in FIG. 4, the curve "e" between the points D and B can also be controlled. When the setting member 57''' is rotated clockwise out of the position controlling the maximum rpm, as shown, the deregulation takes place, although at an rpm below $n_E$. P is such a deregulation point, p is the associated deregulation curve, and $n_3$ is the rpm.

With the exception of the third exemplary embodiment shown in FIG. 3, the adapting control stroke of the follower 47 as well as 47' is determined by an adapting lever 48,48', which is controlled by the shift lever 54, and arranged parallel to the intermediate lever 35. This has the advantage that the regulating movements of the intermediate lever 35 are unaffected by the adapting control movements.

The foregoing relates to preferred exemplary embodiments of the invention, it being understood that other embodiments and variants thereof are possible within the spirit and scope of the invention, the latter being defined by the appended claims.

What is claimed is:

1. In a centrifugal rpm governor for a fuel injection pump of an internal combustion engine, said pump having a fuel supply control member and a drive shaft, the governor including: a housing; centrifugal weight means, including regulating springs, mounted within the housing to the drive shaft for rotation with the drive shaft; an adjusting member connected to the centrifugal weight means and displaceable by the centrifugal weight means as a function of the rpm of the drive shaft against the force of the regulating springs; an intermediate lever connected to the adjusting member and the fuel supply control member; a setting member mounted to the housing to arbitrarily move the fuel supply control member by the intermediate lever; adjustable stop means adjustable in the direction of the longitudinal axis of the fuel supply control member, said adjustable stop means having a contoured stop surface and serving to determine the full load fuel supply quantity of the fuel pump; follower means connected at least indirectly to the intermediate lever for engagement with the contoured stop surface; and force accumulator means connected to the intermediate lever, the improvement in the governor comprising:

an angled shift lever, one arm of which is coupled to the adjusting member and the other arm of which is connected at least indirectly to the intermediate lever, said shift lever serving as a motion translating member and defining a pivot point for the follower means, wherein:

(i) the force accumulator means is stretched as soon as and as long as the intermediate lever is moved in a direction tending to move the fuel supply control member past the adjustable stop means; and (ii) the follower means is shifted relative to the contoured stop surface by the adjusting member through the shift lever, when the adjusting member changes the position of the pivot point on the shift lever causing the follower means to engage the contoured stop surface, said shifting movement being proportional to the adapting control stroke of the adjusting member.

2. The centrifugal rpm governor as defined in claim 1, wherein the improvement further comprises:

connecting link guide member which serves as a connection between the adjusting member and the intermediate lever, said connecting link guide member being adapted to allow a stroke movement of the intermediate lever; and a carrier pin on the intermediate lever for coupling the shift lever and the intermediate lever.

3. The centrifugal rpm governor as defined in claim 1, wherein the improvement further comprises:

an adapting lever arranged parallel to the intermediate lever and having connecting guide means for coupling with the intermediate lever, said adapting lever carrying the follower means at one end thereof and being pivotably connected to the shift lever at the other end thereof.

4. The centrifugal rpm governor as defined in claim 3, wherein the adapting lever and intermediate lever are coupled together so that both levers carry out equidirectional movements to change the position of the fuel supply control member when the adjusting member effects a control movement through the shift lever, which control movement is further effected by the movement of the follower means.

5. The centrifugal rpm governor as defined in claim 3, wherein the force accumulator means is connected between the adapting lever and the intermediate lever.

6. The centrifugal rpm governor as defined in claim 1, wherein the improvement further comprises:

a part on which the force accumulator means is arranged, said part being elastically yielding against the force of a spring of the force accumulator means, and said part serving to carry the follower means, wherein the intermediate lever has a lever arm coupled with the adjustable stop means, said lever arm effecting, due to the action of said adjusting member, a change in position of said stop means relative to the longitudinal axis of the fuel supply control member.

7. The centrifugal rpm governor as defined in claim 1, wherein the adjusting member comprises:

an adapting sleeve;

a regulating sleeve arranged on the same axis with the adapting sleeve, said adapting sleeve directly coupling the centrifugal weight means with the shift lever, and said regulating sleeve being coupled to the intermediate lever; and a pretensed adapting control spring, said regulating sleeve being shifted by means of the adapting control spring.

8. The centrifugal rpm governor as defined in claim 7, wherein both the adapting sleeve and the regulating sleeve are compressed into a rigid subassembly during the idling stroke of the adjusting member by the tension of the adapting control spring, wherein the adjusting member further comprises:

a retraction spring;

a capsule for the retraction spring; and a fixed stop, and wherein the position of the idling stroke is determined by the retraction spring and fixed stop, said adapting control spring and retraction spring comprising the control springs.

9. The centrifugal rpm governor as defined in claim 8, wherein the pretension of the retraction spring is greater than the pretension of the adapting control spring.

10. The centrifugal rpm governor as defined in claim 9, wherein between the idling rpm and maximum rpm the regulating sleeve is blocked by the retraction spring, the adapting sleeve, which is controlled by the centrifugal weight means when the adapting control spring has been retracted, operates on the adapting lever, thereby influencing the position of the follower means in such a manner that the follower means assumes the position corresponding to the instantaneous rpm.

11. The centrifugal rpm governor as defined in claim 10, wherein the improvement further comprises:

an enclosure element, which supports one end of the adapting control spring; and an extension member of the adjusting member, wherein the adapting control spring, the retraction spring, the capsule, the regulating sleeve, the enclosure element and extension member are assembled coaxially and form a control capsule.

12. The centrifugal rpm governor as defined in claim 11, wherein the centrifugal weight means includes a carrier within which a guiding recess is formed for guiding the control capsule, thereby at least partially guiding the adjusting member.

13. The centrifugal rpm governor as defined in claim 12, wherein the carrier defines a stop shoulder for the capsule, said capsule supporting one end of the retraction spring, with the other end of the retraction spring being supported by a shoulder of the regulating sleeve.

14. The centrifugal rpm governor as defined in claim 13, wherein the pretension force of the retraction spring is smaller than the force exerted by the regulating sleeve on the retraction spring when the maximum rpm is attained.

15. The centrifugal rpm governor as defined in claim 3, wherein the improvement further comprises:

weight compensating means for compensating, at least for the most part, the weight of the adapting lever.

16. The centrifugal rpm governor as defined in claim 15, wherein the weight compensating means comprises a pressure spring.

17. The centrifugal rpm governor as defined in claim 15, wherein the weight compensating means comprises a weight attached to the shift lever.

18. The centrifugal rpm governor as defined in claim 1, wherein the improvement further comprises:

a shift lever, and wherein the setting member is supported on a shaft with the shift lever.

19. The centrifugal rpm governor as defined in claim 18, wherein the improvement further comprises:

an adapting lever arranged parallel to the intermediate lever, said adapting lever carrying the follower means at one end thereof and being pivotably connected to the shift lever at the other end thereof;

an additional lever arm connected at one end to the setting member and engageable at the other end with the adapting lever; and an adapting curve element which defines a partial-load adapting curve, said adapting curve element being mounted to the adapting lever with the adapting curve being engageable with the additional lever arm.

20. The centrifugal rpm governor as defined in claim 19, wherein the additional lever arm is provided with a follower roller for engaging the adapting curve, and wherein the adapting curve element serves as a stop, said follower roller engaging and following the adapting curve during displacement of the adapting sleeve, which displacement is transferred to the adapting lever when the adjusting lever is in a partial load position.

21. The centrifugal rpm governor as defined in claim 3, wherein the adapting lever and intermediate lever are coupled together so that both levers carry out equidirectional movements to change the position of the fuel supply control member when the setting member effects a control movement, which control movement is further effected by the movement of the follower means.

22. The centrifugal rpm governor as defined in claim 1, wherein the improvement further comprises:

a part on which the force accumulator means is arranged, said part being elastically yielding against the force of a spring of the force accumulator means, and said part serving to carry the follower means, wherein the intermediate lever has a lever arm coupled with the adjustable stop means, said lever arm effecting, due to the action of said setting member, a change in position of said stop means relative to the longitudinal axis of the fuel supply control member.

* * * * *